US010539050B2

(12) United States Patent
Altherr et al.

(10) Patent No.: US 10,539,050 B2
(45) Date of Patent: Jan. 21, 2020

(54) VALVE DRIVE FOR AN INTERNAL COMBUSTION ENGINE

(71) Applicant: Mahle International GmbH, Stuttgart (DE)

(72) Inventors: Patrick Altherr, Stuttgart (DE); Thorsten Ihne, Stuttgart (DE); David Moczko, Stuttgart (DE); Markus Walch, Bretten (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/942,355

(22) Filed: Mar. 30, 2018

(65) Prior Publication Data

US 2018/0283237 A1 Oct. 4, 2018

(30) Foreign Application Priority Data

Mar. 31, 2017 (DE) ..... 10 2017 205 571

(51) Int. Cl.

| | |
|---|---|
| ***F01L 1/18*** | (2006.01) |
| ***F01L 13/00*** | (2006.01) |
| ***F01L 1/047*** | (2006.01) |

(52) U.S. Cl.

CPC ..... *F01L 13/0005* (2013.01); *F01L 1/047* (2013.01); *F01L 1/18* (2013.01)

(58) Field of Classification Search

CPC ..... F01L 1/047; F01L 1/18; F01L 13/0005
USPC ..... 123/90.16, 90.18, 90.39, 90.44
See application file for complete search history.

(56) References Cited

U.S. PATENT DOCUMENTS

| | | | | |
|---|---|---|---|---|
| 5,129,407 | A | 7/1992 | Phillips | |
| 8,714,125 | B2 * | 5/2014 | Kamichika | F01L 1/047 123/90.16 |

FOREIGN PATENT DOCUMENTS

| | | | |
|---|---|---|---|
| DE | 19945340 | A1 | 3/2001 |
| DE | 10 2010 048 709 | A1 | 4/2012 |
| DE | 10 2011 076726 | A1 | 12/2012 |
| DE | 102014212305 | A1 | 1/2015 |
| DE | 202015009047 | U1 | 8/2016 |

OTHER PUBLICATIONS

English abstract for DE-202015009047.
English abstract for DE-102014212305.
English abstract for DE-10 2010 048 709.
English abstract for DE-199 45 340.

* cited by examiner

*Primary Examiner* — Ching Chang
(74) *Attorney, Agent, or Firm* — Fishman Stewart PLLC

(57) ABSTRACT

A valve drive for an internal combustion engine may include a camshaft, at least one cam follower, and at least one adjusting device. The camshaft may include at least one cam group including a first cam and a second cam. The at least one adjusting device may include a first adjustable engagement element configured to contact a first guide and a second adjustable engagement element configured to contact a second guide of a slotted guide The at least one adjusting device may further include a stop arrangement axially shiftable relative to a rocker lever shaft. The stop arrangement may include a first stop region and a second stop region. At least one of the first engagement element and the second engagement element may be adjustable via the first stop region and the second stop region, respectively, when the stop arrangement is shifted along the rocker lever shaft.

20 Claims, 4 Drawing Sheets

VALVE DRIVE FOR AN INTERNAL COMBUSTION ENGINE

CROSS-REFERENCE TO RELATED APPLICATIONS

This application claims priority to German Patent Application No. DE 10 2017 205 571.5, filed on Mar. 31, 2017, the contents of which are hereby incorporated by reference in its entirety.

TECHNICAL FIELD

The invention relates to a valve drive for an internal combustion engine with a camshaft and with at least one cam follower.

BACKGROUND

The generic valve drives for an internal combustion engine with a camshaft and with at least one cam follower and with at least one cam group non-rotatably fixed on the camshaft with a first cam and with a second cam axially adjacent to the first cam are already known. There, the cam follower is drive-connected in a first position with the first cam of the respective cam group and in a second position with the second cam of the respective cam group.

By way of an adjusting device, the cam follower can be switched between the first position and the second position and thus activate or deactivate a corresponding cylinder of the internal combustion engine. The adjusting device comprises a first adjustable engagement element and a second adjustable engagement element which in each case interact with a guide arranged on the camshaft. The first engagement element and the second engagement element are adjusted between a basic position and a switching position. Conventionally, the respective engagement elements are individually adjusted by linear actuators and the valve drive activated in this way, which however requires major control expenditure. Altogether, the total costs of the valve drive are also significantly increased by relatively expensive linear actuators.

SUMMARY

The object of the invention therefore is to state an alternative embodiment for a valve drive of the generic type, with which the activation of the valve drive is simplified and the total costs are reduced.

According to the invention, this object is solved through the subject of the independent claim(s). Advantageous embodiments are subject of the dependent claim(s).

The present invention is based on the general idea of jointly activating the respective engagement elements in a valve drive and thereby simply the activation of the valve drive and reduced the total costs. For this purpose, the valve drive according to the invention comprises a camshaft and at least one cam follower, wherein the camshaft comprises at least one cam group non-rotatably fixed on the camshaft with a first cam and with a second cam axially adjacent to the first cam. The respective cam follower is drive-connected in a first position with the first cam of the respective cam group and in a second position with the second cam of the respective cam group. For adjusting the cam follower into the first position or into the second position, the valve drive comprises at least one adjusting device which comprises a first adjustable engagement element and a second adjustable engagement element. Here, the first engagement element interacts with a first guide of a slotted guide and the second engagement element interacts with a second guide of a slotted guide arranged on the camshaft. The first engagement element and the second engagement element are alternately adjustable between a basic position and a switching position, wherein in the basic position there is no contact with the associated guide and in the switching position the respective engagement element interacts with the associated guide. According to the invention, the adjusting device comprises a stop arrangement that is axially shiftable relative to a rocker lever shaft with a first stop region for the first engagement element and with a second stop region for the second engagement element. When the stop arrangement is shifted along the rocker lever shaft—i.e. substantially in the direction of the rocker lever shaft—the respective engagement element is then adjustable from the basic position into the switching position by the respective stop region.

By way of the stop arrangement according to the invention, the first engagement element and the second engagement element can be jointly activated by the stop arrangement, as a result of which the activation of the valve drive on the whole is simplified. In addition, the adjusting device can be configured sturdier and simpler in this way, as a result of which the total costs and also the maintenance costs can be advantageously reduced.

When the valve drive is activated, the first engagement element is actuated by the first stop region and the second engagement element by the second stop region of the stop arrangement. The stop arrangement can be configured so that actuating the respective engagement element is supported by an upwards movement of the rocker lever. Accordingly, the stop arrangement moves along the rocker lever shaft into a first switch-over position, wherein the first stop region of the stop arrangement is arranged above the first engagement element. By way of an upwards movement of the rocker lever, the first engagement element also moves up so that the first engagement element is adjusted out of the basic position into the switching position by the first stop region. The first engagement element now interacts with the first guide and the cam follower is moved from the first position into the second position. The rocker lever for example is switched over from a braking mode into a normal mode. When the rocker lever is now switched back, the stop arrangement moves into a second switch-over position and the second stop region is arranged above the second engagement element. By way of an upwards movement of the rocker lever, the second engagement element is actuated by the second stop region and interacts with the second guide. Accordingly, the cam follower is moved from the second position into the first position. Here, the rocker lever is switched over for example from a normal operation to a braking operation.

Advantageously it is provided that the adjusting device comprises a bearing element that is fixed in the valve drive, in particular on the rocker lever shaft or in the rocker lever shaft or in a cylinder head, on which the stop arrangement is shiftably mounted. The bearing element can be configured so that the stop arrangement is guided along the rocker lever shaft and undesirable lateral tilting of the stop arrangement for example because of its own weight is reduced. Thus, the bearing element can be for example a bearing sleeve fixed on the rocker lever shaft and the stop arrangement a stop rod encased by the bearing sleeve in regions. The stop regions can be moulded on the stop rod in that the stop rod is configured U-shaped for example. When shifted along the rocker lever shaft, the stop rod is guided by the bearing sleeve and undesirable lateral tilting of the stop rod prevented.

In order to further support guiding the stop arrangement along the rocker lever shaft and maintain closer activation tolerances, it is advantageously provided that the adjusting device comprises a counter bearing element that is not shiftable relative to the bearing element and that the stop arrangement is shiftably mounted on the bearing element and on the counter bearing element along the rocker lever shaft. The counter bearing element additionally supports the shifting of the stop arrangement so that an undesirable lateral tilting of the stop arrangement for example because of its own weight is prevented. Thus, the bearing element can for example be a bearing sleeve and the counter bearing element a counter bearing sleeve which are fixed on the rocker lever shaft spaced from one another. A stop arrangement in the form of a stop rod with the integrally moulded stop regions can then be shiftably mounted in the bearing sleeve and in the counter bearing sleeve. The stop rod is then guided in the bearing sleeve and in the counter bearing sleeve along the rocker lever shaft and undesirable lateral tilting of the stop rod advantageously prevented. In addition, the activation of the engagement elements can also be performed with a closer activation tolerance.

Alternatively it is provided that the adjusting device comprises a sliding bearing element encasing the rocker lever shaft at least in regions and which is axially shiftable relative to the same and that the stop arrangement is shiftably mounted on the bearing element and on the sliding bearing element along the rocker lever shaft. Thus, the bearing element can for example be a bearing sleeve and the stop arrangement a U-shaped stop rod which on the one side is shiftably mounted in the bearing sleeve and on the other side fixed on the sliding bearing element. The sliding bearing element shifts together with the stop rod along the rocker lever shaft so that undesirable lateral tilting of the stop arrangement is also advantageously prevented here.

It is additionally provided that the stop arrangement is integrally formed on the sliding bearing element. Thus, the sliding bearing element with the integrally formed stop arrangement can be guided along the rocker lever shaft without undesirable lateral tilting of the stop arrangement. To this end, the adjusting device can comprise for example a guide rod which is fixed on the sliding bearing element with the integrally moulded stop arrangement and shiftably arranged on the bearing element. Consequently, the guide rod can shift on the bearing element along the rock lever shaft thus guiding the stop arrangement integrally formed on the sliding bearing element along the rocker lever shaft. In this way, the adjusting device can be configured sturdier and the maintenance costs reduced.

It is also provided that the adjusting device comprises a support arrangement which is integrally formed on the bearing element and/or on the counter bearing element and at least partly encases the stop arrangement. The support arrangement can for example be configured in the form of a guide tube or of a guide profile and additionally support guiding the stop arrangement along the rocker lever shaft. Advantageously, a lateral tilting of the stop arrangement and in particular a deformation of the stop arrangement during the adjustment of the engagement elements can be prevented here.

In order to be able to shift the stop arrangement along the rocker lever shaft it is advantageously provided that the adjusting device comprises a linear actuator fixed on the bearing element, by way of which the stop arrangement is shiftable along the rocker lever shaft. Advantageously, the linear actuator can be an electromagnetic actuator or a hydraulic actuator. Practically, the linear actuator is fixed on the bearing element and on the stop arrangement or alternatively on the guide rod so that the stop arrangement can be adjusted by an adjusting travel of the linear actuator along the rocker lever shaft relative to the bearing element. The adjusting travel is practically sufficient for shifting the stop arrangement from the first switch-over position into the second switch-over position. Multiple linear actuators can also be connected in series in order to achieve the required adjusting travel. Because of the fact that the stop arrangement can actuate the first engagement element and the second engagement element, fewer linear actuators than conventionally are then needed in total and because of this the overall costs of the valve drive advantageously reduced.

In order to reduce a negative influence on the linear actuator, the linear actuator can be arranged in the bearing element. To this end, the bearing element can be a bearing sleeve and the linear actuator be fixed in the bearing sleeve. The stop arrangement can then be a stop rod which is mounted in the bearing sleeve on one side and fixed on the linear actuator. Alternatively, a guide rod can also be fixed on the linear actuator, which guides the sliding bearing sleeve with the integrally formed stop arrangement along the rocker lever shaft.

In order to be able to securely actuate the engagement element it is advantageously provided that the first stop region and/or the second stop region comprises a ramp region. Practically, the ramp region changes its height from a neutral region to a stop region so that the respective engagement element can be switched over more evenly and more quickly. The stop arrangement can for example be a U-shaped stop rod and the ramp regions substantially grow steadily from a longitudinal axis to the outside. The ramp region can also be configured in the form of a double ramp in order to make a continuous adjustment of the respective engagement element and thus of the rocker lever.

In order to securely shift the stop arrangement into the respective switch-over position it is advantageously provided that the adjusting device comprises a resetting arrangement, preferably a spring resetting arrangement, by way of which the stop arrangement is adjustable into a basic stop position. The basic stop position in this case can be the first switch-over position or the second switch-over position or even a neutral position. By way of the resetting arrangement, the stop arrangement is situated in the intended basic stop position even between the switch-over operations, so that a switch-over operation can be started more quickly and the activation is simplified. The spring resetting arrangement makes possible resetting the stop arrangement even in a currentless state so that here the provided basic stop position can also be reached in an energy-saving manner.

It is provided that the resetting arrangement is coaxially fixed on the rocker lever shaft. Thus, the resetting arrangement, in particular the spring resetting arrangement, can be arranged between the rocker lever and for example between the sliding bearing element. The spring resetting arrangement can comprise for example a coil spring, which is arranged coaxially to the rocker lever shaft and encases the same. Alternatively, the spring resetting arrangement can comprise multiple coil springs which lie against the rocker lever shaft axially parallel to the same and are fixed for example on the rocker lever and on the sliding bearing element. In a currentless state, the sliding bearing element can then be shifted to the rocker lever or from the rocker lever along the rocker lever shaft into the basic stop position.

Alternatively or additionally it is provided that the resetting arrangement is fixed on the bearing element or integrally formed on the bearing element. Accordingly, the bearing element for example can be connected with the stop arrangement or also with the guide rod by the resetting arrangement, preferably by the spring resetting arrangement. In a currentless state, the stop arrangement or alternatively the guide rod can then be shifted to the bearing element or from the bearing element along the rocker lever shaft into the basic stop position.

On the whole, the first engagement element and the second engagement element in the valve drive according to the invention can be jointly activated by the stop arrangement as a result of which the activation of the valve drive is simplified and the total costs and the maintenance costs reduced.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

It shows, in each case schematically

DETAILED DESCRIPTION

Figure 1:
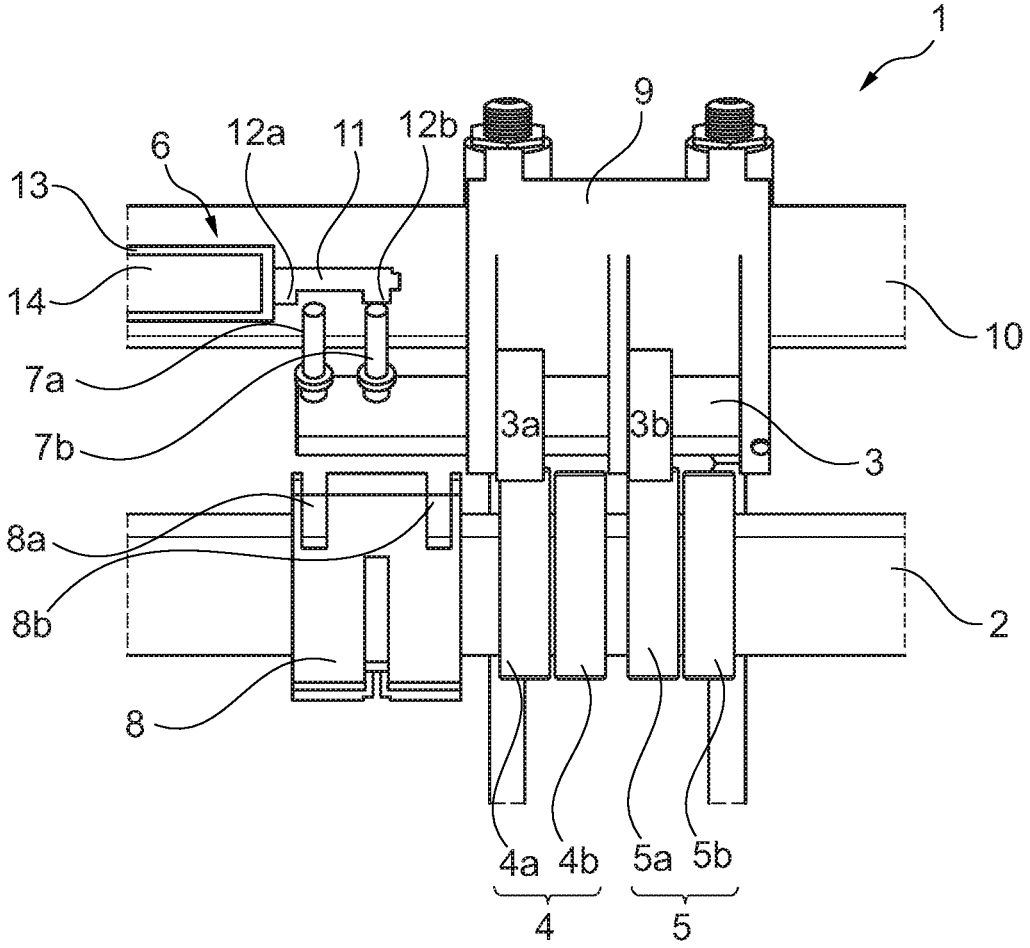
FIG. 1 a view of a valve drive according to the invention.

According to FIG. 1, a valve drive 1 according to the invention comprises a camshaft 2 and a cam follower 3, wherein the camshaft 2 comprises a first cam group 4 and a second cam group 5 which are non-rotatably fixed on the camshaft 2. The first cam group 4 comprises a first cam 4*a* and a second cam 4*b* axially adjacent to the first cam 4*a*. The second cam group 5 comprises a first cam 5*a* and a second cam 5*b* which is fixed on the camshaft 2 adjacent to the first cam 5*a*. The cam follower 3 is drive connected in a first position with the first cams 4*a* and 5*a* of the cam groups 4 and 5 and in a second position with the second cams 4*b* and 5*b* of the cam groups 4 and 5. For this purpose, the cam follower 3 comprises a first roller 3*a* and a second roller 3*b* which each lie against the first cam 4*a* and 5*a* or against the second cam 4*b* and 5*b* and interact with these.

For adjusting the cam follower 3 into the first position or into the second position, the valve drive 1 comprises an adjusting device 6 which comprises a first adjustable engagement element 7*a* and a second adjustable engagement element 7*b*. Here, the first engagement element 7*a* interacts with a first guide 8*a* of a slotted guide and the second engagement element 7*b* interacts with a second guide 8*b* of a slotted guide 8 arranged on the camshaft 2. The first engagement element 7*a* and the second engagement element 7*b* are alternately adjustable between a basic position and a switching position, wherein in the basic position there is no contact with the associated guide 8*a* or 8*b* and in the switching position the respective engagement element 7*a* or 7*b* interacts with the associated guide 8*a* or 8*b*. The cam follower 3 is shiftably arranged in a rocker lever 9, wherein the rocker lever 9 is rotatably fixed on a rocker lever shaft 10.

In order to adjust the engagement elements 7*a* and 7*b*, the adjusting device 6 according to the invention comprises a stop arrangement 11 that is axially shiftable relative to the rocker lever shaft 10 with a first stop region 12*a* for the first engagement element 7*a* and with a second stop region 12*b* for the second engagement element 7*b*. In this exemplary embodiment, the stop arrangement 11 is a U-shaped stop rod. When shifting the stop arrangement 11 along the rocker lever shaft 10, the respective engagement element 7*a* or 7*b* is then adjustable by the respective stop region 12*a* or 12*b* from the basic position into the switching position through an upwards movement of the rocker lever 9.

In addition, the adjusting device 6 comprises a bearing element 13 fixed on the rocker lever shaft 10, on which the stop arrangement 11 is shiftably mounted. The bearing element 13 in this exemplary embodiment is a bearing sleeve, in which the stop arrangement 11 is shiftably mounted by a linear actuator 14 along the rocker lever shaft 10. The linear actuator 14 can for example be an electromagnetic actuator or a hydraulic actuator. By way of the bearing element 13 and the stop arrangement 11 mounted in the bearing element 13 an undesirable lateral tilting of the stop arrangement 11 for example because of its own weight can be additionally reduced.

Figure 2:
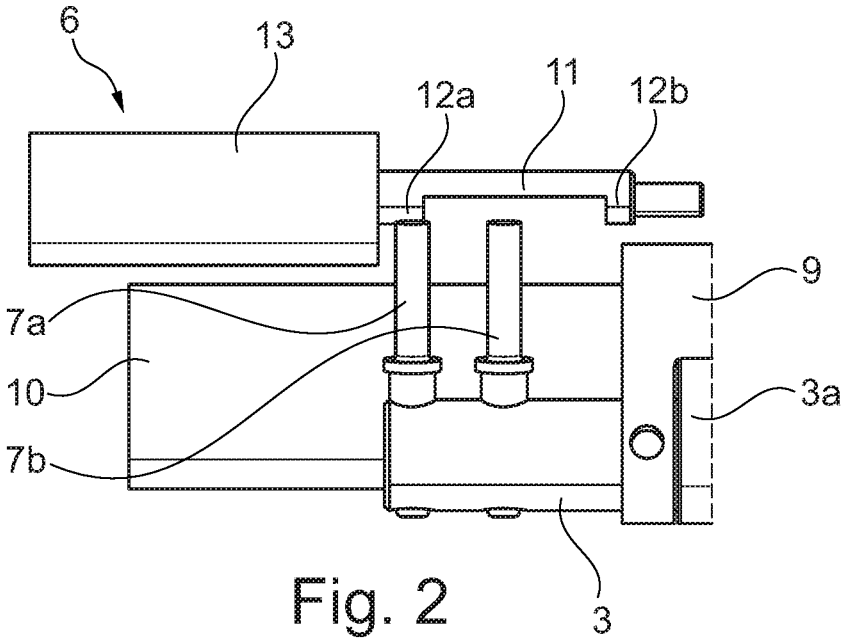
FIG. 2 a view of an adjusting device with a stop arrangement in a first switch-over position.

FIG. 2 shows a view of the adjusting device 6 with the stop arrangement 11 and with the bearing element 13 in the first switch-over position. When activating the valve drive 1, the first engagement element 7*a* is actuated by the first stop region 12*a* and the second engagement element 7*b* by the second stop region 12*b* of the stop arrangement 11. The stop arrangement 11 is designed so that an actuation of the respective engagement element 7*a* or 7*b* is supported by an upwards movement of the rocker lever 9. In the first switch-over position, the first stop region 12*a* of the stop arrangement 11 is arranged above the first engagement element 7*a*. By way of an upwards movement of the rocker lever 9, the first engagement element 7*a* also moves upwards so that by way of the first stop region 12*a* the first engagement element 7*a* is now adjusted from the basic position into the switching position. The first engagement element 7*a* now interacts with the first guide 8*a* and the cam follower 3 is moved from the first position into the second position. In the process, the rocker lever 9 is switched over for example from a braking operation to a normal operation.

Figure 3:
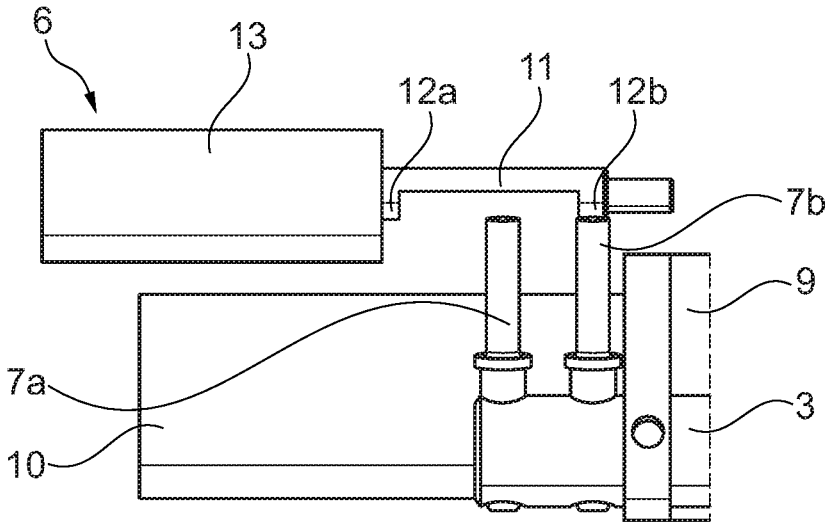
FIG. 3 a view of an adjusting device with a stop arrangement in a second switch-over position.

FIG. 3 shows a view of the adjusting device 6 with the stop arrangement 11 and with the bearing element 13 in the second switch-over position. The second stop region 12*b* is arranged above the second engagement element 7*b*. By way of an upwards movement of the rocker lever 9, the second engagement element 7*b* is actuated by the second stop region 12*b* and interacts with the second guide 8*b*. Accordingly, the cam follower 3 is adjusted from the second position into the first position and the rocker lever 9 is switched over in the process for example from a normal operation to a braking operation.

Figure 4:
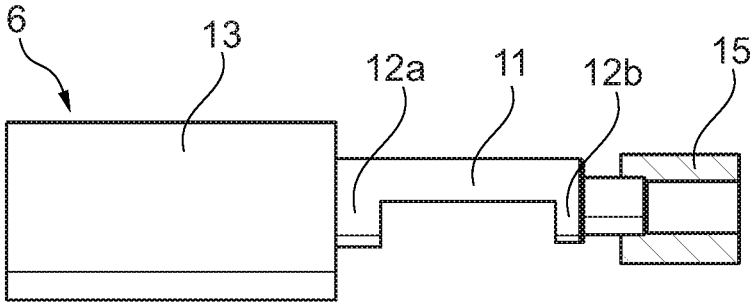
FIG. 4 a view of an adjusting device with a stop arrangement, with a bearing element and with a counter bearing element.

FIG. 4 shows a view of the adjusting device 6 with a counter bearing element 15 in the form of a counter bearing sleeve. The counter bearing element 15 is arranged not shiftable relative to the bearing element 13 and the stop arrangement 11 is shiftably mounted on the bearing element 13 and on the counter bearing element 15 along the rocker lever shaft 10. The counter bearing element 15 supports the shifting of the stop arrangement 11 additionally so that an undesirable lateral tilting of the stop arrangement 11 for example because of its own weight is prevented.

Figure 5:
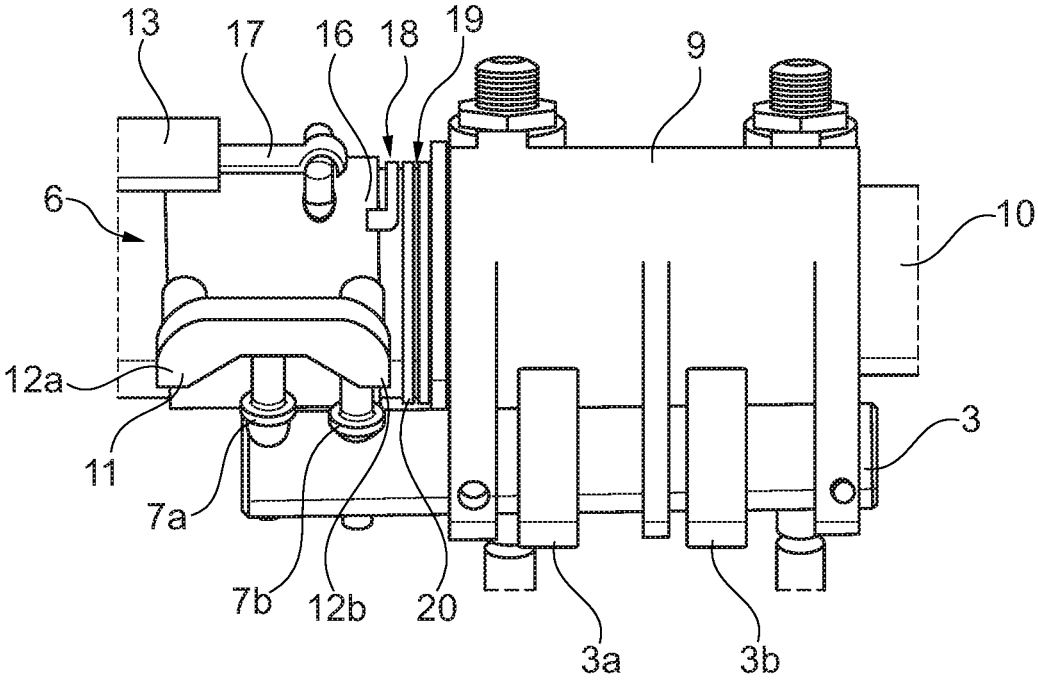
FIG. 5 a view of an adjusting device with a stop arrangement integrally formed on a sliding bearing element.

FIG. 5 shows a view of the adjusting device 6, wherein the stop arrangement 11 is integrally formed on a sliding bearing element 16. The sliding bearing element 16 axially encases the rocker lever shaft 10 and is shiftably mounted on the rocker lever shaft 10. The stop arrangement 11 is integrally formed on the sliding bearing element 16 and, together with the sliding bearing element 16, is guided by a guide rod 17 shiftably mounted on the bearing element 13. Because of this, undesirable lateral tilting of the stop arrangement 11 can be avoided. In this exemplary embodiment, the first stop region 12*a* and the second stop region 12*b* each comprise a ramp region. The ramp region can also be configured in the form of a double ramp in order to make possible a continuous adjustment of the respective engagement element 7*a* and 7*b* and thus of the rocker lever 9.

The adjusting device 6 also comprises a resetting arrangement 18 which in this exemplary embodiment is a spring resetting arrangement 19. The spring resetting arrangement 19 sets the stop arrangement 11 into a basic stop position, which can be the first switch-over position or the second switch-over position or even a neutral position. By way of the spring resetting arrangement 19, the stop arrangement 11 is in the provided basic stop position even between the switch-over operations. Additionally, the spring resetting arrangement 19 makes possible a resetting of the stop arrangement 11 even in a currentless state. In this exemplary embodiment, the spring resetting arrangement 19 comprises a coil spring 20 which is arranged coaxially about the rocker lever shaft 10 between the rocker lever 9 and the sliding bearing element 16 and fixed on these.

Figure 6:
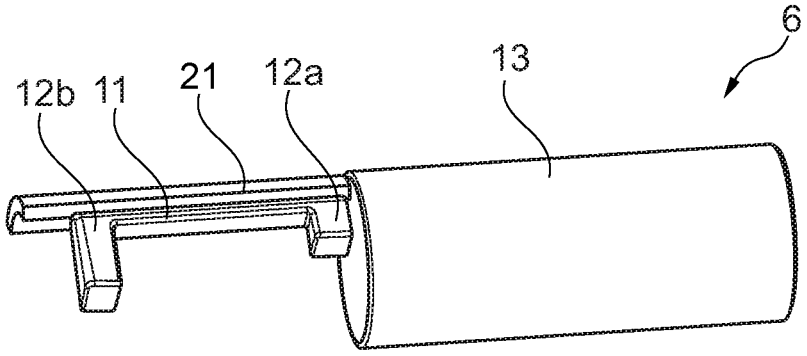
FIG. 6 a view of an adjusting device with a support arrangement moulded on the bearing element.

In FIG. 6, a schematic view of the adjusting device 6 is shown, wherein the adjusting device 6 comprises a support arrangement 21, which is integrally formed on the bearing element 13. The support arrangement 21 in this exemplary embodiment is configured in the form of a guide profile which partly encases the stop arrangement 11. Thus, the stop arrangement 11 is guided in the support arrangement 21 along the rocker lever shaft 10. Advantageously, a lateral tilting of the stop arrangement 11 and in particular a deformation of the stop arrangement 11 during the adjusting of the engagement elements 7*a* or 7*b* can be advantageously prevented.

On the whole, the first engagement element 7*a* and the second engagement element 7*b* in the valve drive 1 according to the invention can be jointly activated by the stop arrangement 11, as a result of which on the whole the activation of the valve drive 1 is simplified. In addition, the number of the linear actuators and because of this the total costs of the valve drive 1 and the maintenance costs can be reduced.

The invention claimed is:

1. A valve drive for an internal combustion engine, comprising:

a camshaft, at least one cam follower, and at least one adjusting device;

the camshaft including at least one cam group non-rotatably fixed on the camshaft, the at least one cam group including a first cam and a second cam disposed axially adjacent to the first cam;

the at least one cam follower being drive-connected to the first cam when in a first position and drive-connected to the second cam when in a second position;

the at least one adjusting device including a first adjustable engagement element comprising a pin and a second adjustable engagement element comprising a pin, the first engagement element and the second engagement element arranged spaced apart from one another on the at least one cam follower;

the first engagement element interacting with a first guide of a slotted guide arranged on the camshaft and the second engagement element interacting with a second guide of the slotted guide arranged on the camshaft;

wherein the first engagement element is alternately adjustable between a first basic position and a first switching position, and the second engagement element is alternately adjustable between a second basic position and a second switching position;

wherein the first engagement element does not contact the first guide when in the first basic position and the first engagement element interacts with the first guide when in the first switching position;

wherein the second engagement element does not contact the second guide when in the second basic position and the second engagement element interacts with the second guide when in the second switching position; and wherein the at least one adjusting device further includes a stop arrangement axially shiftable relative to a rocker lever shaft, the stop arrangement including a first stop region corresponding to the first engagement element and a second stop region corresponding to the second engagement element, the first stop region and the second stop region protruding radially outwardly from the stop arrangement relative to the rocker lever shaft, and wherein at least one of i) the first engagement element is adjustable from the first basic position into the first switching position via the first stop region, and ii) the second engagement element is adjustable from the second basic position into the second switching position via the second stop region, when the stop arrangement is shifted along the rocker lever shaft.

2. The valve drive according to claim 1, wherein the at least one adjusting device further includes a bearing element on which the stop arrangement is shiftably mounted, and wherein the bearing element is structured and arranged to axially guide the stop arrangement along the rocker lever shaft and reduce lateral tilting of the stop arrangement.

3. The valve drive according to claim 2, wherein the at least one adjusting device further includes a linear actuator disposed on the bearing element configured to shift the stop arrangement along the rocker lever shaft.

4. The valve drive according to claim 3, wherein the linear actuator is one of an electromagnetic actuator and a hydraulic actuator.

5. The valve drive according to claim 2, wherein:

the at least one adjusting device further includes a counter bearing element nonshiftably arranged relative to the bearing element, the counter bearing element structured and arranged to axially guide the stop arrangement along the rocker lever shaft and reduce lateral tilting of the stop arrangement; and the stop arrangement is shiftably mounted on the bearing element and on the counter bearing element in a direction of the rocker lever shaft extending substantially along the rocker lever shaft.

6. The valve drive according to claim 5, wherein the at least one adjusting device further includes a support arrangement integrally disposed on at least one of the bearing element and the counter bearing element, and wherein the support arrangement comprises a guide profile and at least partly encases the stop arrangement.

7. The valve drive according to claim 2, wherein:

the at least one adjusting device further includes a sliding bearing element encasing the rocker lever shaft at least in regions and axially displaceable relative to the rocker lever shaft; and the stop arrangement is displaceably mounted on the bearing element and on the sliding bearing element along the rocker lever shaft.

8. The valve drive according to claim 7, wherein the stop arrangement is integrally disposed on the sliding bearing element.

9. The valve drive according to claim 2, wherein the bearing element is arranged one of i) on the rocker lever shaft, ii) in the rocker lever shaft, and iii) in a cylinder head.

10. The valve drive according to claim 2, wherein the bearing element is a bearing sleeve.

11. The valve drive according to claim 1, wherein at least one of the first stop region and the second stop region include a ramp region.

12. The valve drive according to claim 1, wherein the at least one adjusting device further includes a spring resetting arrangement configured to adjust the stop arrangement into a basic stop position.

13. The valve drive according to claim 12, wherein the spring resetting arrangement is coaxially arranged on the rocker lever shaft.

14. The valve drive according to claim 12, wherein the spring resetting arrangement is one of i) fixed on the bearing element and ii) integrally disposed on the bearing element.

15. The valve drive according to claim 1, wherein the stop arrangement is a stop rod having the first stop region and the second stop region.

16. A valve drive for an internal combustion engine, comprising:

a camshaft including at least one cam group non-rotatably fixed on the camshaft, the at least one cam group including a first cam and a second cam disposed axially adjacent to the first cam;

at least one cam follower being drive-connected to the first cam when in a first position and drive-connected to the second cam when in a second position; and at least one adjusting device including a first adjustable engagement element comprising a pin and a second adjustable engagement element comprising a pin, the first engagement element and the second engagement element arranged spaced apart from one another on the at least one cam follower, the first engagement element interacting with a first guide of a slotted guide arranged on the camshaft when in a first switching position and not contacting the first guide when in a first basic position, the second engagement element interacting with a second guide of the slotted guide arranged on the camshaft when in a second switching position and not contacting the second guide when in a second basic position, the at least one adjusting device further including a spring resetting arrangement and a stop arrangement axially shiftable relative to a rocker lever shaft, the stop arrangement including a first stop region corresponding to the first engagement element and a second stop region corresponding to the second engagement element, the first stop region and the second stop region protruding radially outwardly from the stop arrangement relative to the rocker lever shaft, the spring resetting arrangement configured to adjust the stop arrangement into a basic stop position;

wherein at least one of i) the first engagement element is adjustable from the first basic position into the first switching position via the first stop region, and ii) the second engagement element is adjustable from the second basic position into the second switching position via the second stop region, when the stop arrangement is shifted along the rocker lever shaft; and wherein at least one of the first stop region and the second stop region include a ramp region.

17. The valve drive according to claim 16, wherein the at least one adjusting device further includes a bearing element and the stop arrangement is shiftably mounted on the bearing element, and wherein the bearing element is structured and arranged to axially guide the stop arrangement along the rocker lever shaft and reduce lateral tilting of the stop arrangement.

18. The valve drive according to claim 17, wherein:

the at least one adjusting device further includes a counter bearing element nonshiftably arranged relative to the bearing element, the counter bearing element structured and arranged to axially guide the stop arrangement along the rocker lever shaft and reduce lateral tilting of the stop arrangement; and the stop arrangement is shiftably mounted on the bearing element and on the counter bearing element in a direction of the rocker lever shaft extending substantially along the rocker lever shaft.

19. A valve drive for an internal combustion engine, comprising:

a camshaft including at least one cam group non-rotatably fixed on the camshaft, the at least one cam group including a first cam and a second cam disposed axially adjacent to the first cam;

at least one cam follower drive-connected to the first cam when in a first position and drive-connected to the second cam when in a second position; and at least one adjusting device including:

a first adjustable engagement element comprising a pin and a second adjustable engagement element comprising a pin, the first engagement element and the second engagement element arranged spaced apart from one another on the at least one cam follower, the first engagement element interacting with a first guide of a slotted guide arranged on the camshaft when in a first switching position and not contacting the first guide when in a first basic position, the second engagement element interacting with a second guide of the slotted guide arranged on the camshaft when in a second switching position and not contacting the second guide when in a second basic position;

a stop arrangement axially shiftable relative to a rocker lever shaft, the stop arrangement including a stop rod having a first stop region corresponding to the first engagement element and a second stop region corresponding to the second engagement element;

a bearing sleeve and a counter bearing sleeve nonshiftably arranged relative to the bearing sleeve, the stop arrangement shiftably mounted on the bearing sleeve and the counter bearing sleeve in a direction of the rocker lever shaft extending substantially along the rocker lever shaft;

a linear actuator disposed on the bearing sleeve configured to shift the stop arrangement along the rocker lever shaft; and wherein at least one of i) the first engagement element is adjustable from the first basic position into the first switching position via the first stop region, and ii) the second engagement element is adjustable from the second basic position into the second switching position via the second stop region, when the stop arrangement is shifted along the rocker lever shaft.

20. The valve drive according to claim 19, wherein the linear actuator is one of an electromagnetic actuator and a hydraulic actuator.

* * * * *